US008985717B2

(12) United States Patent
Marzorati

(10) Patent No.: US 8,985,717 B2
(45) Date of Patent: Mar. 24, 2015

(54) HINGE ASSEMBLY FOR HOUSEHOLD APPLIANCES HAVING AN HORIZONTALLY-PIVOTED FRONT DOOR

(75) Inventor: Luca Marzorati, Porcia (IT)

(73) Assignee: Electrolux Home Products Corporation N.V., Brussels (BE)

( * ) Notice: Subject to any disclaimer, the term of this patent is extended or adjusted under 35 U.S.C. 154(b) by 15 days.

(21) Appl. No.: 13/881,981

(22) PCT Filed: Sep. 21, 2011

(86) PCT No.: PCT/EP2011/066370

§ 371 (c)(1),
(2), (4) Date: Apr. 26, 2013

(87) PCT Pub. No.: WO2012/062506

PCT Pub. Date: May 18, 2012

(65) Prior Publication Data

US 2013/0214663 A1 Aug. 22, 2013

(30) Foreign Application Priority Data

Nov. 11, 2010 (EP) ..... 10014483

(51) Int. Cl.
*E05F 5/06* (2006.01)
*E05D 7/00* (2006.01)
(Continued)

(52) U.S. Cl.
CPC ..... *E05D 7/00* (2013.01); *E05F 1/1261* (2013.01); *A47B 96/00* (2013.01); *E05Y 2900/304* (2013.01); *E05Y 2900/308* (2013.01); *E05Y 2900/20* (2013.01)
USPC ..... 312/319.2; 49/386; 16/286

(58) Field of Classification Search
CPC ..... F24C 15/023; E05Y 2201/21; E05Y 2900/20; E05Y 2201/416; E05Y 2900/308; E05Y 2900/304; E05D 7/00; E05F 1/1261; A47B 96/00
USPC ..... 16/286; 49/386; 312/319.2, 319.3, 327, 312/328, 228; 126/191, 194
See application file for complete search history.

(56) References Cited

U.S. PATENT DOCUMENTS 1,616,471 A * 2/1927 Stackhouse ..... 126/191
1,640,036 A * 8/1927 Hueckel ..... 126/191
(Continued)

FOREIGN PATENT DOCUMENTS

CN 101718163 A 6/2010
DE 1628803 A1 11/1971
(Continued)

OTHER PUBLICATIONS

International Searching Authority, International Search Report for International Application No. PCT/EP2011/066370, mailed Dec. 2, 2011, 4 pages, European Patent Office, The Netherlands.

*Primary Examiner* — Janet M Wilkens
(74) *Attorney, Agent, or Firm* — Alston & Bird LLP

(57) ABSTRACT

Hinge assembly for household appliances having an horizontally-pivoted front door, and which comprises: a first coupling element; a second coupling element; and a door-weight balancing device; the door-weight balancing device in turn comprising a supporting rod; a compression-preloaded elastically-deformable member which is fitted to the supporting rod so as to have a first end firmly fixed to the distal end of the supporting rod and a second end; a linking mechanism which connects the proximal end of the supporting rod to the second coupling element, so that the supporting rod is axially moved to further compress the elastically-deformable member when the second coupling element rotates from the first to the second working position; and an adjustable spacer element which is structured so to allow a manually-operated adjustment, thus varying the compression preload of the elastically-deformable member fitted on the supporting rod.

12 Claims, 4 Drawing Sheets

(51) Int. Cl.
*E05F 1/12* (2006.01)
*A47B 96/00* (2006.01)

(56) References Cited

U.S. PATENT DOCUMENTS

| | | | | | |
|---|---|---|---|---|---|
| 3,196,482 | A * | 7/1965 | Bates | 16/290 |
| 3,503,380 | A * | 3/1970 | Vasaturo | 126/191 |
| 3,698,781 | A * | 10/1972 | Dunn | 312/327 |
| 3,749,080 | A * | 7/1973 | Kleinhenn | 126/191 |
| 4,665,892 | A * | 5/1987 | Spargo et al. | 126/194 |
| 8,201,304 | B2 * | 6/2012 | Steurer et al. | 16/286 |
| 8,286,306 | B2 * | 10/2012 | Vanini | 16/290 |
| 2003/0172920 | A1 * | 9/2003 | Gronbach | 126/197 |
| 2011/0131886 | A1 * | 6/2011 | Durr | 49/386 |
| 2011/0146654 | A1 * | 6/2011 | Basavalingappa Mudbasal et al. | 126/194 |
| 2014/0097172 | A1 * | 4/2014 | Kang et al. | 219/394 |

FOREIGN PATENT DOCUMENTS

| | | | |
|---|---|---|---|
| DE | 3140039 | A1 | 4/1983 |
| EP | 0565809 | A1 | 10/1993 |
| EP | 1602883 | A2 | 12/2005 |

* cited by examiner

HINGE ASSEMBLY FOR HOUSEHOLD APPLIANCES HAVING AN HORIZONTALLY-PIVOTED FRONT DOOR

CROSS REFERENCE TO RELATED APPLICATIONS

This application is a national stage application, filed under 35 U.S.C. §371, of International Application No. PCT/EP2011/066370, filed Sep. 21, 2011, which claims priority to European Patent Application No. 10014483.1, filed Nov. 11, 2010, both of which are hereby incorporated by reference in their entirety.

BACKGROUND

The present invention relates to a hinge assembly for household appliances having an horizontally-pivoted front door.

More specifically, the present invention relates to a hinge assembly for a home dishwasher having an horizontally-pivoted front door, and to a front-loading dishwasher provided with such hinge assembly, implementation to which the following description refers purely by way of example without implying any loss of generality.

As is known, today's front-loading dishwashers generally comprise a substantially parallelepiped-shaped, outer casing which is structured for resting on the floor, and is provided with an inner washing chamber which communicates with the outside through a substantially rectangular crockery loading/unloading opening formed in the vertically-oriented front wall of the casing; a substantially rectangular-shaped front door which is pivotally-jointed to the front wall of the casing via two lateral hinge assemblies structured to allow free rotation of the door about a horizontally-oriented rotation axis which is located immediately beneath the access opening to the washing chamber; and usually two dish-racks which are housed inside the washing chamber one above the over, and are fixed to the inner surface of the washing chamber in drawer-like manner so to be manually extractable from the washing chamber through the crockery loading/unloading opening on front wall of the casing.

More specifically, the two hinge assemblies are located on opposite sides of the front door, close to the lower horizontal edge of the door, and are aligned one another so as to allow manual rotation of the door about the door rotation axis, between a raised position in which the front door is oriented substantially vertically and rests completely against the front wall of the casing to close the crockery loading/unloading opening and watertight seal the washing chamber, and a lowered position in which the front door is oriented substantially horizontally, beneath the crockery loading/unloading opening, so as to give the user free access to the washing chamber via the crockery loading/unloading opening.

Each hinge assembly of currently marketed front-loading dishwashers usually comprises: a first coupling plate which is substantially perpendicular to the front-door rotation axis and is structured for being firmly fixed to a corresponding vertical lateral wall of the casing, immediately adjacent the crockery loading/unloading opening of the front wall; a second coupling plate which is structured for being firmly fixed to the door side body, and is pivotally jointed to the first coupling plate so as to be able to rotate about the door rotation axis, between a first working position wherein the front door of the dishwasher is arranged in the raised position, and a second working position wherein the front door of the dishwasher is arranged in the completely lowered position; and finally a door-weight balancing device which is interposed between the first and the second coupling plate and it is structured for elastically hampering rotation of the second coupling plate with respect to the first coupling plate from the first to the second working position, so as to get a very slow lowering of the front door.

Additionally, several models of hinge assembly currently on the market are also structured so as to allow an on-site adjustment of the hampering effect of the door-weight balancing device, according to the actual weight of the front door. This solution avoids an on-site replacement of the standard hinge assemblies when a particularly heavy covering panel is firmly fixed to the front door of the dishwasher to hide the household appliance. This problem is typical of built-in front-loading dishwashers and similar household appliances.

Hinge assemblies having an on-site adjustable door-weight balancing device are disclosed in DE3140039 and EP1602883.

The main drawback of the hinge assembly disclosed in DE3140039 is that the on-site adjustable door-weight balancing device is too complicated to tune up because the user is requested to act on two distinct adjusting mechanisms, namely the front screw and the internal sleeve, and only one of these adjusting mechanisms is directly accessible from the front wall of the casing.

The main drawback of the hinge assembly disclosed in EP1602883 is that the on-site adjustable door-weight balancing device is structured to allow only a few step-by-step discrete adjustments of the hampering effect of the door-weight balancing device. Moreover the elastic member of the on-site adjustable door-weight balancing device is a tensile-stressed helical spring which traditionally has a non linear response to loads, with all problems concerned.

BRIEF SUMMARY

Aim of the present invention is to realize a hinge assembly for front-loading dishwashers which allows a continuous adjustment of hampering effect of the door-weight balancing device via a single adjusting mechanism directly accessible from the front wall of the casing.

In compliance with the above aims, according to the present invention there is provided a hinge assembly as specified in Claim 1 and preferably, though not necessarily, in any one of the dependant claims.

Moreover, according to the present invention, there is also provided a household appliances as specified in Claim 11 and preferably, though not necessarily, in any one of the dependent claims.

BRIEF DESCRIPTION OF THE FIGURES

A non-limiting embodiment of the present invention will now be described, by way of example, with reference to the accompanying drawings, in which:

FIG. 4 show an isometric view of a component part of the FIG. 2 hinge assembly; whereas

DETAILED DESCRIPTION OF VARIOUS EMBODIMENTS

Figure 1:
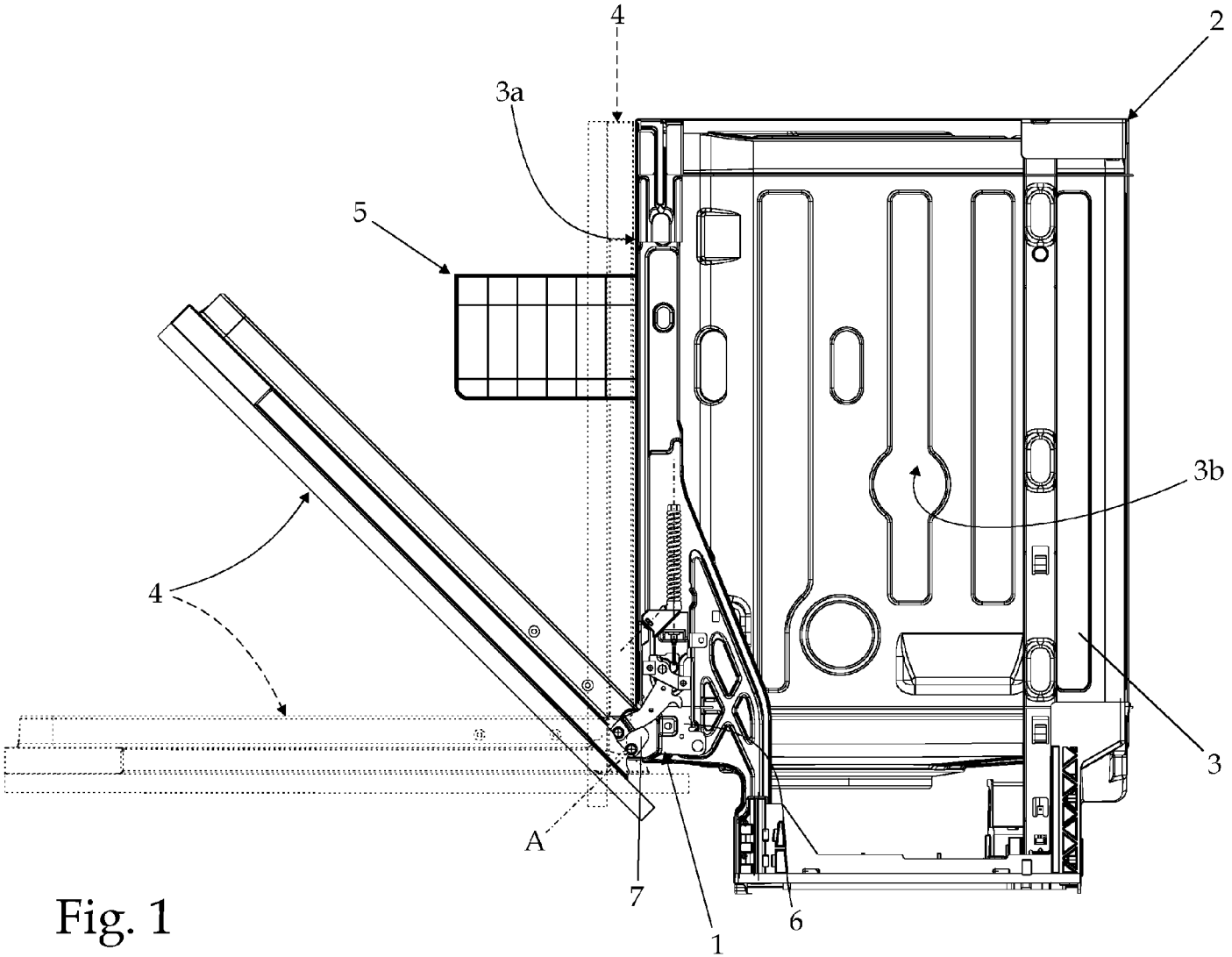
FIG. 1 shows a lateral view, with parts removed for clarity, of a front-loading dishwasher provided with a couple of hinge assemblies realized in accordance with the teachings of the present invention.

With reference to FIG. 1, number 1 indicates as a whole a hinge assembly specifically structured for being used in a household appliance 2 having an horizontally-pivoted front door, such as a stand-alone or built-in, front-loading dishwasher or a stand-alone or built-in, gas or electric oven.

In the example shown, in particular, reference is made to a built-in front-loading dishwasher 2 which preferably, though not necessarily, comprises:

a substantially parallelepiped-shaped, rigid outer casing 3 which is structured for being stably fitted into a piece of kitchen furniture (not shown) and/or for resting on the floor, and is provided with a preferably, though not necessarily, substantially parallelepiped-shaped, inner washing chamber which communicates with the outside through a preferably, though not necessarily, substantially rectangular-shaped, crockery loading/unloading opening realized in the substantially vertically-oriented, front wall 3*a* of outer casing 3; and a preferably, though not necessarily, substantially flat and rectangular-shaped, front door 4 which is pivotally-jointed to front wall 3*a* of outer casing 3 via two reciprocally aligned hinge assemblies 1 (only one is shown in FIG. 1) which are located on opposite sides of front door 4, so to allow free rotation of front door 4 about a substantially horizontally-oriented rotation axis A which lays on or extends locally substantially parallel to the front wall 3*a* of casing 3, immediately beneath the crockery loading/unloading opening.

More specifically, the two hinge assemblies 1 are preferably located on opposite sides of front door 4, close to the lower horizontal edge of the door, and are aligned one another so as to allow manual rotation of front door 4 about axis A, between a raised position in which front door 4 is oriented substantially vertically and rests completely against the front wall 3*a* of casing 3 to close the crockery loading/unloading opening and watertight seal the washing chamber; and a completely lowered position in which front door 4 is oriented substantially horizontally, beneath the crockery loading/unloading opening, so as to give the user free access to the washing chamber via the crockery loading/unloading opening on front wall 3*a*.

With reference to FIG. 1, alike today's front-loading dishwashers, dishwasher 2 preferably, though not necessarily, also comprises one or more dish-racks 5 (only one is shown in FIG. 1) which are housed inside the washing chamber preferably, though not necessarily, one above the other, and each of which is structured for housing the crockery to be washed and is preferably, though not necessarily, fixed to the inner surface of the washing chamber in drawer-like manner so to be manually extractable from the washing chamber through the crockery loading/unloading opening on front wall 3*a*.

Casing 3, front door 4, and dish-racks 5 are commonly known parts in the dishwashers technical field and therefore won't be described in further details.

Figure 2:
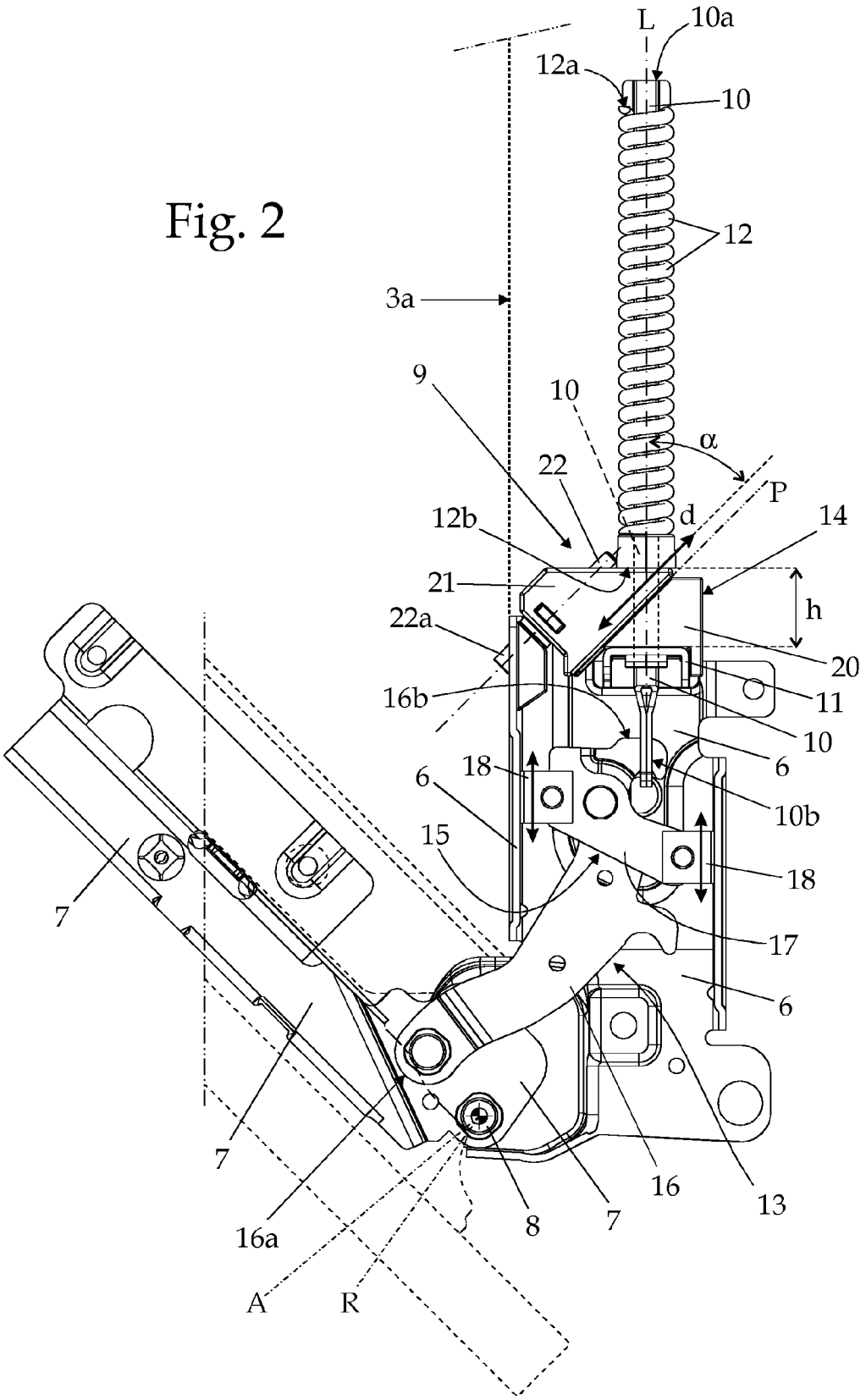
FIG. 2 shows a front view, with parts in section and parts removed for clarity, of one of the two hinge assemblies of the FIG. 1 dishwasher.
Figure 3:
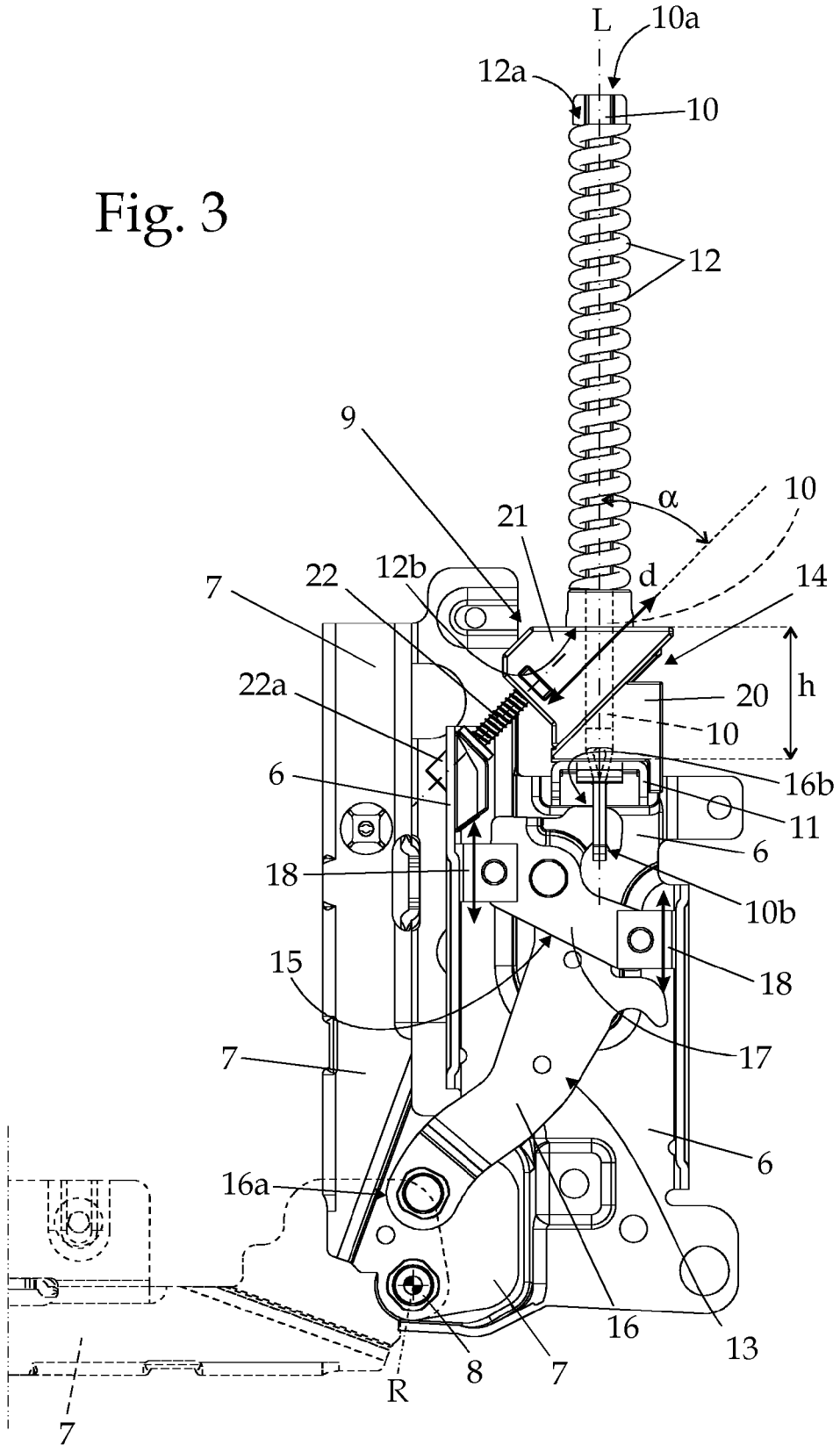
FIG. 3 shows a front view of the FIG. 2 hinge assembly in a different operative configuration.

With reference to FIGS. 1, 2 and 3, each hinge assembly 1 comprises:

a first coupling plate 6 which is structured for being firmly fixed to a corresponding lateral wall 3*b* of outer casing 3, immediately adjacent to lower horizontal edge of the crockery loading/unloading opening on front wall 3*a*, so as to lay on a reference plane locally substantially perpendicular to the door rotation axis A;

a second coupling plate 7 which is substantially parallel to coupling plate 6, is pivotally jointed to coupling plate 6 via a transversal pin 8 extending coaxial to a reference axis R locally substantially perpendicular to both coupling plates 6 and 7, and it is finally structured for being firmly fixed to the body of front door 4 so that reference axis R of transversal pin 8 is locally substantially coincident to door rotation axis A, thus to be able to rotate about axis R, i.e. about the door rotation axis A, between a first working position (shown in solid line in FIG. 3) wherein front door 4 is arranged in the raised position, and a second working position (shown in dotted line in FIG. 3) wherein front door 4 is arranged in the completely lowered position; and a door-weight balancing device 9 which is interposed between coupling plates 6 and 7 and is structured for elastically hampering rotation of coupling plate 7 with respect to coupling plate 6 at least from the first to the second working position, so to almost completely balance the overall weight of front door 4 for significantly slowing down or event stop the gravity movement of front door 4 from the raised position to the completely lowered position.

The door-weight balancing device 9, in turn, comprises: a straight supporting rod 10 which is coaxial to a longitudinal axis L substantially parallel to coupling plate 6 (i.e. supporting rod 10 lays on a plane substantially perpendicular to the door rotation axis A), and extends in axially sliding manner through a transversally protruding tailpiece 11 which juts out from coupling plates 6; a compression-preloaded helical spring or similar elastically-deformable tubular member which is fitted to supporting rod 10 so as to have a first end 12*a* rigidly fixed to the distal end 10*a* of supporting rod 10, and a second end 12*b* in abutment against the protruding tailpiece 11 of coupling plate 6, so that axial movement of supporting rod 10 varies the length of helical spring 12; and a linking mechanism 13 which connects the proximal end 10*b* of supporting rod 10 to coupling plate 7, at a given distance from reference axis R of transversal pin 8 (i.e. from door rotation axis A), so that supporting rod 10 is axially moved with respect to protruding tailpiece 11 to further compress helical spring 12 when coupling plate 7 rotates from the first to the second working position, and returns to its maximum length when coupling plate 7 rotates back to the first working position.

With reference to FIGS. 2 and 3, differently from currently marketed hinge assemblies, the door-weight balancing device 9 additionally comprises an adjustable spacer element 14 which is interposed between the protruding tailpiece 11 and the second end 12*b* of helical spring 12, and which is structured so as to allow a manually-operated continuous adjustment, between a lower value and a higher value, of the distance h between the protruding tailpiece 11 and the second end 12*b* of helical spring 12.

In other words, being the first end 12*a* of helical spring 12 rigidly fixed to the distal end 10*a* of supporting rod 10, the adjustable spacer element 14 directly increases or reduces the actual maximum length of helical spring 12 on supporting rod 10 and, therefore, it allows a manually-operated continuous adjustment of the compression preload of helical spring 12 between a lower value and a higher value.

In the example shown, in particular, the linking mechanism 13 preferably comprises a movable guide member 15 which is fixed in sliding manner onto coupling plate 6, approximately between protruding tailpiece 11 and transversal pin 8, so as to be substantially aligned to supporting rod 10 on opposite side of tailpiece 11 with respect to spacer element 14, and so as to be freely movable onto coupling plate 6 towards and backwards the protruding tailpiece 11 in a direction locally substantially parallel to the rod longitudinal axis L. The movable guide member 15 is moreover directly faced to, and rigidly connected to, the proximal end 10*b* of supporting rod 10 so as to move axially the supporting rod 10 with respect to protruding tailpiece 11.

In addition to the above, the linking mechanism 13 also comprises a substantially flat, connecting arm or rod 16 which extends on a plane locally substantially perpendicular to reference axis R, and has a first end 16*a* directly hinged to coupling plate 7 at a given distance from pin 8, and a second end 16*b* hinged to guide member 15, so that the whole connecting arm 16 is able to both freely move above coupling plate 6 towards and backwards the protruding tailpiece 11 in a direction locally substantially parallel to the rod longitudinal axis L, and to freely rotate with respect to coupling plate 7 and guide member 15 while remaining on a plane locally substantially perpendicular to reference axis R of transversal pin 8.

In other words, connecting arm or rod 16 connects coupling plate 7 to guide member 15 so to transform the rotating movement of coupling plate 7 about reference axis R, i.e. the rotating movement of front door 4 about door rotation axis A, into an axial reciprocating movement of supporting rod 10 through protruding tailpiece 11.

In the example shown, in particular, guide member 15 preferably, though not necessarily, consists of a substantially flat, transversal rocket arm 17 which extends immediately above coupling plate 6, approximately between protruding tailpiece 11 and transversal pin 8, and which has its intermediate section both rigidly connected to the proximal end 10*b* of supporting rod 10, and pivotally jointed to connecting arm or rod 16. The two opposite ends of rocket arm 17 are finally hinged each to a respective sliding block 18 which, in turn, is fixed in sliding manner to coupling plate 6 so as to be able to freely slide on the body of supporting plate 6 in a direction locally substantially parallel to the longitudinal axis L of supporting rod 10 and helical spring 12, towards and backwards protruding tailpiece 11.

Figure 4:
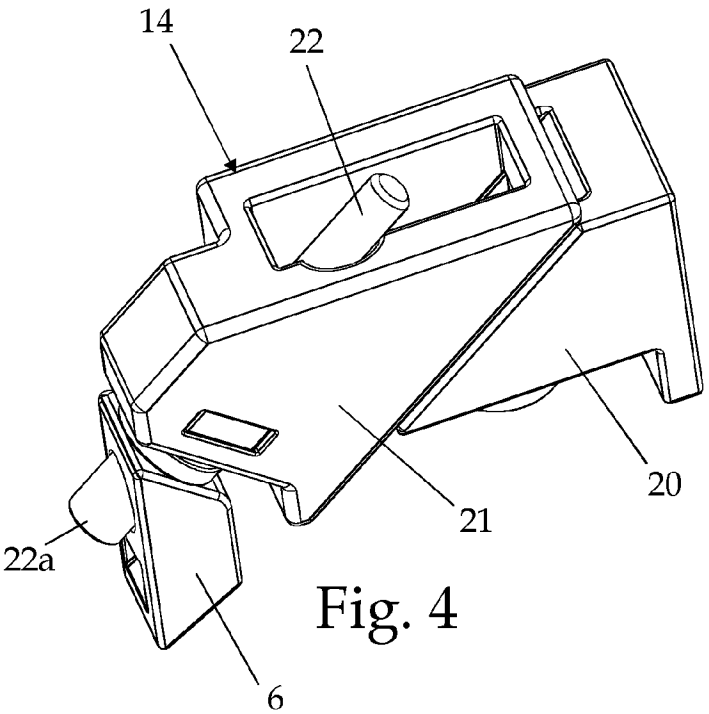

In turn, with reference to FIGS. 2, 3 and 4, the adjustable spacer element 14 comprises two substantially wedge-shaped blocks or bodies 20 and 21 which are piled up roughly aligned to the longitudinal axis L of supporting rod 10, and are fitted to supporting rod 10 between the protruding tailpiece 11 and the second end 12*b* of helical spring 12, so that the wedge-shaped block 20 abuts exclusively against the protruding tailpiece 11, and the wedge-shaped block 21 abuts exclusively against the end 12*b* of helical spring 12.

In the example shown, in particular, a washer or bushing is preferably, though not necessarily, interposed between the second end 12*b* of helical spring 12 and the wedge-shaped block 21, i.e. the adjustable spacer element 14.

Additionally the two wedge-shaped blocks 20 and 21 are structured so to be able to slide/move one onto the other along a preferably, though not necessarily, straight travelling direction d having a vectorial component parallel to the longitudinal axis L of supporting rod 10, so that any reciprocal movement of the wedge-shaped blocks 20 and 21 causes a variation of the overall high of the adjustable spacer element 14 parallel to longitudinal axis L and, as a consequence, a variation of the distance h between the protruding tailpiece 11 and the second end 12*b* of helical spring 12.

In the example shown, in particular, travelling direction d is preferably, though not necessarily, locally parallel to coupling plate 6, and is tilted of an angle $\alpha$ preferably, though not necessarily, ranging between 5° and 85° with respect to the longitudinal axis L of supporting rod 10.

More specifically, travelling direction d is preferably, though not necessarily, tilted of an angle $\alpha$ equal to 30° or 45° with respect to the longitudinal axis L of supporting rod 10.

In addition to the above, adjustable spacer element 14 is provided with a manually-operated adjusting mechanism 22 which is structured so to both prevent any undesired reciprocal movement of the two wedge-shaped blocks 20 and 21, and to selectively move the two wedge-shaped blocks 20 and 21 one with respect to the other along the direction d, so to permit a continuous manually-operated adjustment of the distance h between the protruding tailpiece 11 and the second end 12*b* of helical spring 12 and, as a consequence, of the actual compression preload of helical spring 12 fitted on supporting rod 10.

With reference to FIGS. 2 and 3, in the example shown, in particular, the wedge-shaped block 20 is rigidly fixed to the protruding tailpiece 11; and the wedge-shaped block 21 abuts against helical spring 12, or rather the washer or bushing on the second end 12*b* of helical spring 12, with a substantially flat upper surface locally perpendicular to the longitudinal axis L of supporting rod 10, so as to allow the second end 12*b* of helical spring 12 to freely slide on wedge-shaped block 21.

The manually-operated adjusting mechanism 22, in turn, rigidly connects the wedge-shaped block 21 to the coupling plate 6, and it is structured so to selectively move the wedge-shaped block 21 with respect to coupling plate 6, onto the wedge-shaped block 20 along direction d, for alternatively increasing or reducing the overall high of the adjustable spacer element 14 and, as a consequence, continuously adjusting the distance h between the protruding tailpiece 11 and the second end 12*b* of helical spring 12.

More specifically, with reference to FIGS. 2, 3 and 4, in the example shown wedge-shaped block 20 is preferably provided with a central through cavity dimensioned to allow exclusively axial displacements of supporting rod 10; whereas wedge-shaped block 21 is provided with a central through cavity dimensioned to allow both axial and transversal displacements of supporting rod 10 parallel to coupling plate 6, and rests onto wedge-shaped block 20 on a flat contact surface which lays on a reference plane P locally perpendicular to coupling plate 6 and locally tilted of an angle $\alpha$ preferably, though not necessarily, ranging between 5° and 85° with respect to the longitudinal axis L of supporting rod 10, so that any transversal movement of wedge-shaped block 21 with respect to supporting rod 10 and wedge-shaped block 20 causes an increase or reduction of the distance h between the protruding tailpiece 11 and the flat upper surface of wedge-shaped block 21 against which the second end 12*b* of helical spring 12 abuts.

The adjusting mechanism 22, in turn, preferably consists of a connecting screw 22 which is fixed in axially rotating manner to coupling plate 6, beside wedge-shaped block 21, and extends towards wedge-shaped block 21 while remaining locally parallel to travelling direction d up to reach and screw into the body of the wedge-shaped block 21, so that any rotation of the connecting screw 22 causes a sliding of the wedge-shaped block 21 onto the wedge-shaped block 20 along direction d and, as a consequence, causes an increase or reduction of the distance h between the protruding tailpiece 11 and the flat upper surface of the wedge-shaped block 21 against which the second end 12*b* of helical spring 12 abuts.

General operation of front-loading dishwasher 2 is clearly inferable from the above description, with no further explanation required.

As regards hinge assembly 1, coupling plate 6 is structured for being fixed to the lateral wall 3*b* of outer casing 3 immediately beside the crockery loading/unloading opening on front wall 3*a*, so that the head 22*a* of connecting screw 22, i.e. the manually-operated adjusting mechanism 22, crops out of front wall 3*a* beside the crockery loading/unloading opening, and it is easily accessible to the user when front door 4 is not in the raised position. The door-weight balancing device 9 therefore allows an on-site, manually-operated adjustment of the compression preload of the helical spring 12 fitted on supporting rod 10.

The particular structure of door-weight balancing device 9 offers several advantages. First of all, the door-weight balancing device 9 allows the user to manually adjust the compression preload of helical spring 12 in a continuous and extremely precise manner, simply acting exclusively on the manually-operated adjusting mechanism 22, i.e. on the head 22*a* of connecting screw 22.

Moreover, in the door-weight balancing device 9 the adjustment speed of the compression preload of helical spring 12 depends solely on the tilt angle α of the travelling direction d with respect to the longitudinal axis L of supporting rod 10, thus even a few turns of the connecting screw 22 can cause relevant variation of the helical-spring compression preload. A tilt angle α approximately equal to 45° offers the best compromise between speed and adjustment accuracy of the helical-spring compression preload.

In addition to the above, the head 22*a* of the adjusting screw 22 of the on-site adjustable door-weight balancing device 9 is located on the front wall 3*a* of casing 3, in a raised position which is easy reachable by the user without removing the household appliance from the niche in the kitchen furniture where it is recessed.

In other words, the adjusting mechanism of the on-site adjustable door-weight balancing device 9 is located in a raised position which is particularly user friendly.

Last but not least, in hinge assembly 1 the on-site adjustable door-weight balancing device 9 is wholly integrated in coupling plate 6, thus the assembly of hinge assembly 1 on the appliance casing is greatly simplified and cost-effective.

Clearly, changes may be made to the household appliance 2 and to hinge assembly 1 as described herein without, however, departing from the scope of the present invention.

For example, in a non-shown structural variation of hinge assembly 1, transversal pin 8 may be replaced by a multilink leverage mechanism which is preferably, though not necessarily, structured to allow a free rotation of coupling plate 7 with respect to coupling plate 6 about a rotation axis locally substantially perpendicular to both coupling plates 6 and 7, and, at the same time, a transversal displacement of coupling plate 7 with respect to coupling plate 6 in a direction locally perpendicular to said rotation axis. In this case, the door rotation axis A is therefore allowed to space out from front wall 3*a* of outer casing 3 while front door 4 rotates about axis A.

Figure 5:
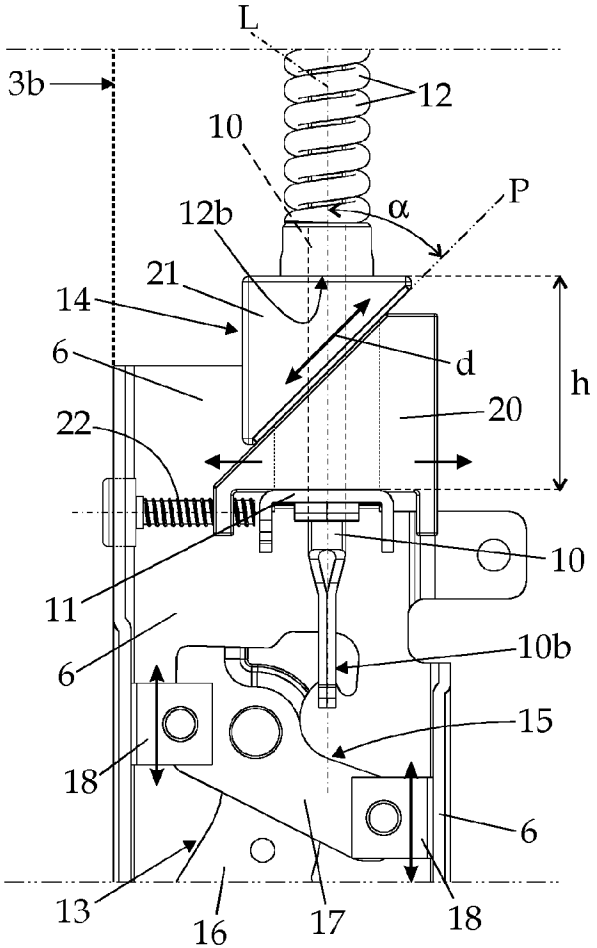
FIG. 5 shows a front view of an alternative embodiment of the FIG. 2 hinge assembly with parts in section and parts removed for clarity.

Additionally, with reference to FIG. 5, in a different embodiment of the adjustable spacer element 14 the wedge-shaped block 20 abuts against the protruding tailpiece 11 with the possibility to slide above tailpiece 11 in a direction locally parallel to coupling plate 6 and preferably, though not necessarily, roughly perpendicular to the longitudinal axis L of supporting rod 10.

The wedge-shaped block 21 instead is fitted to supporting rod 10 exclusively in axially sliding manner, and rests onto the wedge-shaped block 20 on a flat contact surface which lays on a reference plane P locally perpendicular to coupling plate 6 and locally tilted of an angle α preferably, though not necessarily, ranging between 5° and 85° with respect to the longitudinal axis L of supporting rod 10, so that any transversal displacement of wedge-shaped block 20 with respect to supporting rod 10 obliges the wedge-shaped block 21 to slide onto the wedge-shaped block 20 along a travelling direction d having a vectorial component parallel to longitudinal axis L of supporting rod 10, thus causing an increase or reduction of the distance h between the protruding tailpiece 11 and the second end 12*b* of helical spring and, as a consequence, an increase or reduction of the compression preload of helical spring 12 fitted on supporting rod 10.

As regards the manually-operated adjusting mechanism 22, in this embodiment it consists of a connecting screw 22 which is fixed in axially rotating manner to coupling plate 6, beside the wedge-shaped block 20, and extends towards wedge-shaped block 20 while remaining locally perpendicular to the longitudinal axis L of supporting rod 10, i.e. locally parallel to the sliding direction of wedge-shaped block on protruding tailpiece 11, up to reach and screw into the body of the wedge-shaped block 20, so that any rotation of connecting screw 22 causes a sliding of the wedge-shaped block 21 onto the wedge-shaped block 20 along the travelling direction d, thus causing an increase or reduction of the distance h between the protruding tailpiece 11 and the second end 12*b* of helical spring 12.

As regards instead the household appliance 2, one of the two hinge assemblies 1 connecting the front door 4 to the front wall 3*a* of casing 3 may be replaced by a traditional hinge assembly which is either provided with or lacks a corresponding door-weight balancing device.

The invention claimed is:

1. Hinge assembly (1) for household appliances (2) having an horizontally-pivoted front door (4), and which comprises:

a first coupling element (6) structured for being firmly fixed to a household appliance casing (3);

a second coupling element (7) structured for being firmly fixed to the front-door (4), and which is pivotally jointed to the first coupling element (6) so as to be able to rotate about a given articulation axis (R), between a first working position wherein the front door (4) is arranged in the raised position, and a second working position wherein the front door (4) is arranged in the completely lowered position; and a door-weight balancing device (9) which is interposed between the first (6) and the second coupling element (7) and is structured to elastically hamper rotation of the second coupling element (7) at least from the first to the second working position;

the door-weight balancing device (9) in turn comprising a supporting rod (10) which extends in sliding manner through a supporting portion (11) of the first coupling element (6), a compression-preloaded elastically-deformable member (12) which is fitted to the supporting rod (10) so as to have a first end (12*a*) fixed to the distal end (10*a*) of the supporting rod (10) and a second end (12*b*) acting on the supporting portion (11) of the first coupling element (6), and a linking mechanism (13) which connects the proximal end (10*b*) of the supporting rod (10) to the second coupling element (7), so that the supporting rod (10) is axially moved to further compress the elastically-deformable member (12) when the second coupling element (7) rotates from the first to the second working position;

the hinge assembly (1) being characterized in that the door-weight balancing device (9) also comprises an adjustable spacer element (14) which is interposed between the second end (12*b*) of the elastically-deformable member (12) and the supporting portion (11) of the first coupling element (6), and which is structured so to allow a manually-operated adjustment, between a lower value and a higher value, of the distance (h) between the second end (12*b*) of the elastically-deformable member (12) and the supporting portion (11) of the first coupling element (6), thus varying the compression preload of the elastically-deformable member (12) fitted on the supporting rod (10).

2. Hinge assembly according to claim 1, characterized in that the adjustable spacer element (14) comprises two substantially wedge-shaped blocks (20, 21) which are piled up roughly aligned to the longitudinal axis (L) of the supporting rod (10), and are fitted to the supporting rod (10) between the second end (12*b*) of the elastically-deformable member (12) and the supporting portion (11) of the first coupling element (6); the two substantially wedge-shaped blocks (20, 21) being additionally structured so to be able to move one onto the other along a given travelling direction (d) having a vectorial component parallel to the longitudinal axis (L) of the supporting rod (10), so that any reciprocal movement of the two substantially wedge-shaped blocks (20, 21) causes a variation of the distance (h) between the second end (12*b*) of the elastically-deformable member (12) and the supporting portion (11) of the first coupling element (6).

3. Hinge assembly according to claim 2, characterized in that said travelling direction (d) is locally tilted of an angle (a) ranging between 5° and 85° with respect to the longitudinal axis (L) of the supporting rod (10).

4. Hinge assembly according to claim 3, characterized in that said travelling direction (d) is locally tilted of an angle (a) approximately equal to 30° or 45° with respect to the longitudinal axis (L) of the supporting rod (10).

5. Hinge assembly according to claim 4, characterized in that the adjustable spacer element (14) is also provided with manually-operated adjusting means (22) which are structured so to both prevent any undesired reciprocal movement of the two substantially wedge-shaped blocks (20, 21), and to selectively move the two substantially wedge-shaped blocks (20, 21) one with respect to the other along said travelling direction (d).

6. Hinge assembly according to claim 5, characterized in that a first of the substantially wedge-shaped blocks (20) is firmly fixed to the supporting portion (11) of the first coupling element (6); that a second of the substantially wedge-shaped blocks (21) abuts against the elastically-deformable member (12) with a substantially flat upper surface locally perpendicular to the longitudinal axis (L) of the supporting rod (10); and that said manually-operated adjusting means (22) rigidly connect the second substantially wedge-shaped block (21) to the first coupling element (6), and are also structured so to selectively move the second substantially wedge-shaped block (21) with respect to the first coupling element (6) along said travelling direction (d).

7. Hinge assembly according to claim 6, characterized in that said manually-operated adjusting means (22) comprise a connecting screw (22) which is fixed in axially rotating manner to the first coupling element (6), beside one of the two substantially wedge-shaped blocks (20, 21), and extends towards said substantially wedge-shaped block (20, 21) up to reach and screw into the body of said wedge-shaped block (20, 21), so that any rotation of the connecting screw (22) causes a reciprocal movement of the two substantially wedge-shaped blocks (20, 21) along said travelling direction (d).

8. Hinge assembly according to claim 5, characterized in that a first of the substantially wedge-shaped blocks (20) abuts against the supporting portion (11) of the first coupling element (6) with the possibility to slide above said supporting portion (11) in a transversal direction locally inclined to the longitudinal axis (L) of the supporting rod (10); that a second of the substantially wedge-shaped blocks (21) is fitted in axially sliding manner to the supporting rod (10); and that said manually-operated adjusting means (22) rigidly connect the first substantially wedge-shaped block (20) to the first coupling element (6), and are also structured so to selectively move the first substantially wedge-shaped block (20) with respect to the first coupling element (6) along said travelling direction (d).

9. Hinge assembly according to claim 1, characterized in that the elastically-deformable member (12) is a helical spring (12) fitted on the supporting rod (10).

10. Hinge assembly according to claim 1, characterized in that the linking mechanism (13) comprises:

a movable guide member (15) which is fixed in sliding manner onto the first coupling element (6), between the supporting portion (11) of the first coupling element (6) and a transversal pin (8) connecting the first (6) to the second coupling element (7), so as to be substantially aligned to the supporting rod (10) on opposite side of the supporting portion (11) of said first coupling element (6) with respect to the adjustable spacer element (14), and to freely move onto the first coupling element (6) towards and backwards said supporting portion (11) in a direction locally substantially parallel to the longitudinal axis (L) of the supporting rod (10); and a connecting arm (16) which has a first end (16*a*) directly hinged to the second coupling element (7), at a given distance from the transversal pin (8) connecting the first (6) to the second coupling element (7), and a second end (16*b*) hinged to the movable guide member (15), so to transform the rotating movement of the second coupling element (7) about the pin reference axis (R) into an axial reciprocating movement of the supporting rod (10) through the supporting portion (11) of the first coupling element (6);

the movable guide member (15) being rigidly connected to the proximal end (10*b*) of the supporting rod (10) so as to move axially the supporting rod (10) (11) with respect to the supporting portion (11) of the first coupling element (6).

11. Household appliance (2) comprising an outer casing (3) which is structured for being stably fitted into a piece of kitchen furniture (not shown) and/or for resting on the floor, and it is provided with inner chamber which communicates with the outside through a loading/unloading opening realized in a front wall (3*a*) of said outer casing (3); and a front door (4) which is pivotally-jointed to the front wall (3*a*) of the outer casing (3) via two reciprocally aligned hinge assemblies (1) which are located on opposite sides of the front door (4), so to allow free rotation of the front door (4) about a substantially horizontally-oriented rotation axis (A) which lays on or extends locally substantially parallel to the front wall (3*a*) of the outer casing (3), immediately beneath the loading/unloading opening; the household appliance (2) being characterized in that at least one of said hinge assemblies (1) is realized according to claim 1.

12. Household appliance according to claim 11, characterized in that said household appliance is a stand-alone or built-in, front-loading dishwasher (2) or a stand-alone or built-in oven.

* * * * *